US008299012B2

(12) United States Patent
Mathur

(10) Patent No.: US 8,299,012 B2
(45) Date of Patent: Oct. 30, 2012

(54) HARD SURFACE TREATMENT COMPOSITIONS

(75) Inventor: Dilip Shanker Mathur, East Brunswick, NJ (US)

(73) Assignee: Reckitt Benckiser LLC, Parsippany, NJ (US)

( * ) Notice: Subject to any disclaimer, the term of this patent is extended or adjusted under 35 U.S.C. 154(b) by 458 days.

(21) Appl. No.: 12/675,170

(22) PCT Filed: Aug. 15, 2008

(86) PCT No.: PCT/GB2008/002761

§ 371 (c)(1),
(2), (4) Date: Mar. 16, 2010

(87) PCT Pub. No.: WO2009/030873

PCT Pub. Date: Mar. 12, 2009

(65) Prior Publication Data

US 2010/0263693 A1 Oct. 21, 2010

(30) Foreign Application Priority Data

Sep. 7, 2007 (GB) ..... 0717397.4

(51) Int. Cl.
*C11D 3/20* (2006.01)
*C11D 3/37* (2006.01)

(52) U.S. Cl. ..... 510/475; 510/238; 510/362; 510/364; 510/426; 510/477; 510/506

(58) Field of Classification Search ..... 510/238, 510/362, 364, 426, 475, 477, 506
See application file for complete search history.

(56) References Cited

U.S. PATENT DOCUMENTS

| | | | | |
|---|---|---|---|---|
| 5,158,710 | A | 10/1992 | Vaneenam | |
| 5,707,957 | A | 1/1998 | Yianakopoulos | |
| 2005/0026802 | A1 * | 2/2005 | Kilkenny et al. | 510/295 |
| 2005/0155628 | A1 * | 7/2005 | Kilkenny et al. | 134/6 |
| 2006/0241010 | A1 * | 10/2006 | Boone et al. | 510/488 |
| 2009/0197786 | A1 * | 8/2009 | Perry et al. | 510/191 |
| 2010/0235975 | A1 * | 9/2010 | Cheung et al. | 4/222 |
| 2011/0039754 | A1 * | 2/2011 | DeDominicis et al. | 510/362 |

FOREIGN PATENT DOCUMENTS

| | | | |
|---|---|---|---|
| GB | 2429015 | A | 2/2007 |
| WO | 2004011587 | A1 | 2/2004 |
| WO | 2004074421 | A1 | 9/2004 |
| WO | 2006131690 | A1 | 12/2006 |
| WO | 2007042750 | A1 | 4/2007 |
| WO | 2007104921 | A1 | 9/2007 |

* cited by examiner

*Primary Examiner* — Gregory Webb
(74) *Attorney, Agent, or Firm* — Norris McLaughlin & Marcus PA

(57) ABSTRACT

An improved hard surface treatment compositions which comprises (preferably consists essentially of; yet more preferably consists of) the following constituents: a detersive anionic surfactant; a detersive nonionic surfactant; an alkylene glycol ether solvent; a phenyl containing glycol ether solvent; an organic acid, preferably an organic acid selected from citric acid, lactic acid and mixtures thereof; optionally but preferably a film forming polymer based on quaternized copolymers of vinylpyrrolidone and dimethylaminoethyl methacrylate, optionally one or more further constituents which may improve aesthetic or functional features of the compositions, and, water.

16 Claims, 1 Drawing Sheet

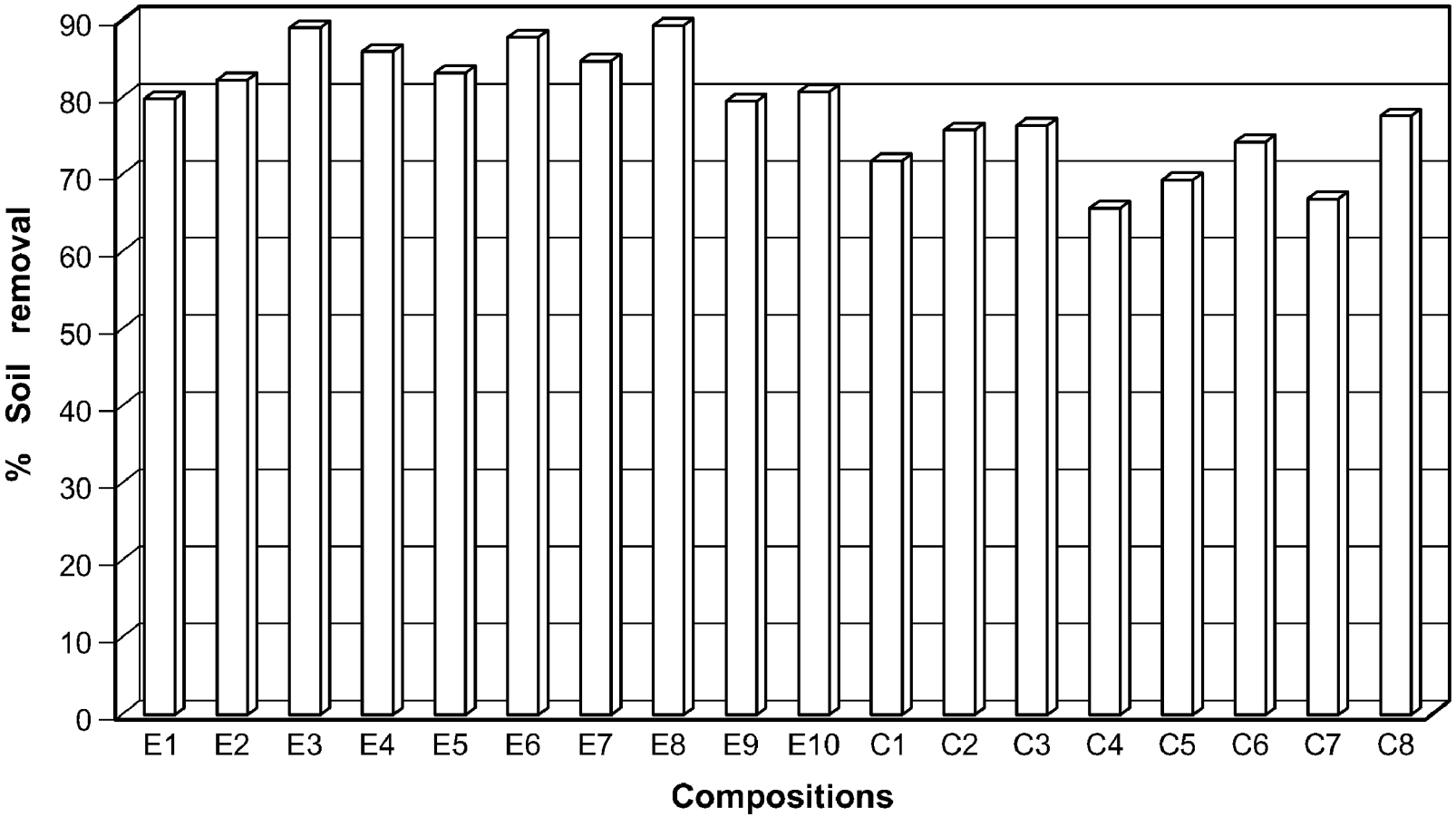
% Soil removal
90
80
70
60
50
40
30
20
10
0
E1
E2
E3
E4
E5
E6
E7
E8
E9
E10
C1
C2
C3
C4
C5
C6
C7
C8
Compositions

HARD SURFACE TREATMENT COMPOSITIONS

This is an application filed under 35 USC 371 of PCT/GB2008/002761.

The present invention relates to improved hard surface treatment compositions.

While the art is replete with a large number of cleaning compositions useful for the cleaning of hard surfaces there nonetheless remains a real and continuing need in the art for further improved cleaning compositions useful in the cleaning of hard surfaces, particularly those having reduced amounts of organic constituents while at the same time providing good cleaning performance.

In a first aspect of the invention there is provided an improved hard surface treatment compositions which comprises (preferably consists essentially of; yet more preferably consists of) the following constituents:

a detersive anionic surfactant;

a detersive nonionic surfactant;

an alkylene glycol ether solvent;

a phenyl containing glycol ether solvent;

an organic acid, preferably an organic acid selected from citric acid, lactic acid and mixtures thereof; and, water;

and optionally one or more further constituents which may improve aesthetic or functional features of the inventive compositions.

In a second aspect of the invention there is provided an improved hard surface treatment compositions according to the invention which comprises (preferably consists essentially of; yet more preferably consists of) the following constituents:

a detersive anionic surfactant;

a detersive nonionic surfactant;

an alkylene glycol ether solvent;

a phenyl containing glycol ether solvent;

an organic acid, preferably an organic acid selected from citric acid, lactic acid and mixtures thereof;

a film forming polymer based on quaternized copolymers of vinylpyrrolidone and dimethylaminoethyl methacrylate; and, water;

and optionally one or more further constituents which may improve aesthetic or functional features of the inventive compositions.

In a third aspect the present invention provides improved hard surface treatment compositions according to the first, or second aspects recited above, further wherein the detersive nonionic surfactant constituent consists essentially of a pair of individual nonionic surfactants which are present in respective weight ratios of 0.5-1:0.5-1, more preferably in a respective weight ratio of 0.75-1:0.75-1.

According to a fourth aspect the present invention provides improved hard surface treatment compositions according to first, second or third aspects recited above, further wherein the detersive nonionic surfactant constituent comprises two or more nonionic surfactants which are based on an alkyl alkoxylate wherein the alkyl group present in the molecule of each of the two or more nonionic surfactants is the same, but the two or more nonionic surfactants differ from one another only in the degree of alkoxylation, preferably only in the degree of ethoxylation, wherein the differences in the degree of alkoxylation is not more than 60%, preferably is not more than 50% and yet more preferably is not more than 35%, with reference to the nonionic surfactant having the highest degree or amount of alkoxylation.

According to a fifth aspect of the invention there is provided improved hard surface treatment compositions according to first, second or third aspects recited above where the organic solvents present in the inventive compositions are a pair of organic solvents with the first being the alkylene glycol ether solvent constituent, and the second being the phenyl containing glycol ether solvent constituent and wherein the respective weight ratios of the former to the latter are maintained at 1:1 or less, preferably 1:0.1-0.75, still more preferably 1:0.1-0.6, and yet more preferably 1:0.15-0.55.

According to a yet further aspect of the invention there is provided a method for the cleaning of a hard surface, which method comprises the step of applying a cleaning effective amount of the composition of the invention according to any of the aspects of the invention recited herein to a hard surface in need of a cleaning treatment, particularly in need of cleaning greasy soils from a hard surface.

According to a still further aspect of the invention there is provided an improved method for the manufacture of a hard surface cleaning composition according to any of the inventive aspects described herein.

The inventive compositions necessarily include at least detersive anionic surfactant, preferably one or more anionic surfactants of the sulfate and/or sulfonate type, and especially preferably is at least one anionic surfactant of the sulfate type with an anionic surfactant of the sulfonate type. Examples of anionic surfactants include alcohol sulfates and sulfonates, alcohol phosphates and phosphonates, alkyl ester sulfates, alkyl diphenyl ether sulfonates, alkyl sulfates, alkyl ether sulfates, sulfate esters of an alkylphenoxy polyoxyethylene ethanol, alkyl monoglyceride sulfates, alkyl sulfonates, alkyl ether sulfates, alpha-olefin sulfonates, beta-alkoxy alkane sulfonates, alkyl ether sulfonates, ethoxylated alkyl sulfonates, alkylaryl sulfonates, alkylaryl sulfates, alkyl monoglyceride sulfonates, alkyl carboxylates, alkyl ether carboxylates, alkyl alkoxy carboxylates having 1 to 5 moles of ethylene oxide, alkylpolyglycolethersulfates (containing up to 10 moles of ethylene oxide), sulfosuccinates, octoxynol or nonoxynol phosphates, taurates, fatty taurides, fatty acid amide polyoxyethylene sulfates, acyl glycerol sulfonates, fatty oleyl glycerol sulfates, alkyl phenol ethylene oxide ether sulfates, paraffin sulfonates, alkyl phosphates, isethionates, N-acyl taurates, alkyl succinamates and sulfosuccinates, alkylpolysaccharide sulfates, alkylpolyglucoside sulfates, alkyl polyethoxy carboxylates, and sarcosinates or mixtures thereof. Further examples of anionic surfactants include alkyl-diphenyl-ethersulphonates and alkyl-carboxylates.

As noted previously the anionic surfactant present in the inventive compositions is preferably one or more anionic surfactants of the sulfate and/or sulfonate type Preferred anionic surfactants of the sulfate type include alkyl sulfates which may be represented by the following general formula:

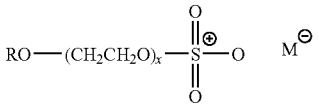

wherein R is an straight chain or branched alkyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium, or is ammonium or substituted ammonium cation, and x is from 0 to about 4. Of these, most preferred are the non-ethoxylated $C_{12}$-$C_{15}$ primary and secondary alkyl sulfates.

Exemplary commercially available alkyl sulfates include one or more of those available under the tradenames RHODAPON® (ex. Rhone-Poulenc Co.) as well as STEPANOL® (ex. Stepan Chemical Co.). Exemplary alkyl sulfates which is preferred for use is a sodium lauryl sulfate surfactant presently commercially available as RHODAPON® LCP (ex. Rhone-Poulenc Co.), as well as a further sodium lauryl sulfate surfactant composition which is presently commercially available as STEPANOL® WAC (ex. Stepan Chemical Co.).

Preferred anionic surfactants of the sulfonate type include alkyl sulfonate anionic surfactants which may be represented according to the following general formula:

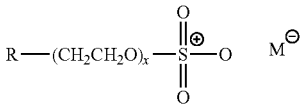

wherein R is an straight chain or branched alkyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium, or is ammonium or substituted ammonium cation, and x is from 0 to about 4. Most preferred are the $C_{12}$-$C_{15}$ primary and secondary alkyl sulfates.

Exemplary commercially available alkane sulfonate surfactants include one or more of those available under the tradename HOSTAPUR® (ex. Clariant). An exemplary and particularly alkane sulfonate which is preferred for use is a secondary sodium alkane sulfonate surfactant presently commercially available as HOSTAPUR® SAS from Hoechst Celanese.

The anionic surfactant, especially preferably when the at least one anionic surfactant is of the sulfate and/or sulfonate type may be included in amounts of from about 0.01%-10% by weight, more desirably from about 0.01%-5% by weight. based on the total weight of the compositions of which they form a part.

In certain particularly preferred embodiments both at least one anionic surfactant of the sulfate type is concurrently present with at least one anionic surfactant of the sulfonate type as the detersive anionic surfactants of the invention, and especially preferably to the exclusion of anionic surfactants of types other than of the sulfonate type and of the sulfate type. Particularly preferred anionic surfactants and preferred amounts of such anionic surfactants are disclosed with reference to one or more of the following Examples.

The inventive compositions also necessarily include at least one detersive nonionic surfactant, preferably which are selected from: polyalkylene oxide condensates of alkyl phenols, condensation products of aliphatic alcohols with alkylene oxides, and primary and secondary linear and branched alcohol alkoxylates.

Exemplary useful nonionic surfactants based on polyalkylene oxide condensates of alkyl phenols include the condensation products of alkyl phenols having an alkyl group containing from about 6 to 12 carbon atoms in either a straight chain or branched chain configuration with an alkylene oxide, especially an ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

Exemplary useful nonionic surfactants based on condensation products of aliphatic alcohols with alkylene oxides include the condensation products of aliphatic alcohols with from about 1 to about 60 moles of an alkylene oxide, especially an ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). Other examples are those $C_6$-$C_{11}$ straight-chain alcohols which are ethoxylated with from about 3 to about 6 moles of ethylene oxide. Their derivation is well known in the art. Examples include Alfonic® 810-4.5, which is described in product literature from Sasol as a C8-10 having an average molecular weight of 356, an ethylene oxide content of about 4.85 moles (about 60 wt. %), and an HLB of about 12; Alfonic® 810-2, which is described in product literature as a $C_8$-$C_{10}$ having an average molecular weight of 242, an ethylene oxide content of about 2.1 moles (about 40 wt. %), and an HLB of about 12; and Alfonic® 610-3.5, which is described in product literature as having an average molecular weight of 276, an ethylene oxide content of about 3.1 moles (about 50 wt. %), and an HLB of 10. Other examples of alcohol ethoxylates are C10 oxo-alcohol ethoxylates available from BASF under the Lutensol® ON tradename. They are available in grades containing from about 3 to about 11 moles of ethylene oxide (available under the names Lutensol® ON 30; Lutensol® ON 50; Lutensol® ON 60; Lutensol® ON 65; Lutensol® ON 66; Lutensol® ON 70; Lutensol® ON 80; and Lutensol®ON 110). Other examples of ethoxylated alcohols include the Neodol® 91 series non-ionic surfactants available from Shell Chemical Company which are described as $C_9$-$C_{11}$ ethoxylated alcohols. The Neodol® 91 series non-ionic surfactants of interest include Neodol® 91-2.5, Neodol® 91-6, and Neodol® 91-8. Neodol® 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Further examples of ethoxylated alcohols include the Rhodasurf® DA series non-ionic surfactants available from Rhodia which are described to be branched isodecyl alcohol ethoxylates. Rhodasurf® DA-530 has been described as having 4 moles of ethoxylation and an HLB of 10.5; Rhodasurf® DA-630 has been described as having 6 moles of ethoxylation with an HLB of 12.5; and Rhodasurf® DA-639 is a 90% solution of DA-630. Further examples of ethoxylated alcohols include those from Tomah Products (Milton, Wis.) under the Tomadol® tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear $C_9/C_{10}/C_{11}$ and n is 2.5, 6, or 8; 1-3; 1-5; 1-7; 1-73B; 1-9; where R is linear $C_{11}$ and n is 3, 5, 7 or 9; 23-1; 23-3; 23-3; 23-5; 23-6.5—where R is linear $C_{12}/C_{13}$ and n is 1, 3, 5, or 6.5; 25-3; 25-7; 25-9; 25-12—where R is linear $C_{12}/C_{13}/C_{14}/C_{15}$ and n is 3, 7, 9, or 12; and 45-7; 45-13—where R is linear $C_{14}/C_{15}$ and n is 7 or 13.

A further class of useful nonionic surfactants include primary and secondary linear and branched alcohol alkoxylates, include those such as those based on $C_6$-$C_{18}$ alcohols which further include an average of from 2 to 80 moles of ethoxylation per mol of alcohol. These examples include the Genapol® UD (ex. Clariant, Muttenz, Switzerland) described under the tradenames Genapol® UD 030, $C_{11}$-oxo-alcohol polyglycol ether with 3 EO; Genapol® UD, 050 $C_{11}$-oxo-alcohol polyglycol ether with 5 EO; Genapol® UD 070, $C_{11}$-oxo-alcohol polyglycol ether with 7 EO; Genapol® UD 080, $C_{11}$-oxo-alcohol polyglycol ether with 8 EO; Genapol® UD 088, $C_{11}$-oxo-alcohol polyglycol ether with 8 EO; and Genapol® UD 110, $C_{11}$-oxo-alcohol polyglycol ether with 11 EO. Still further useful are those surfactants having a formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from about 1 to about 12. Surfactants of this formula are presently marketed under the Genapol® tradename (ex. Clariant), which surfactants include the "26-L" series of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1, 26-L-1.6, 26-L-2, 26-L-3, 26-L-5, 26-L-45, 26-L-50, 26-L-60, 26-L-60N, 26-L-75, 26-L-80, 26-L-98N, and the 24-L series, derived from synthetic sources and typically contain about 55% $C_{12}$ and 45% $C_{14}$ alcohols, such as 24-L-3, 24-L-45, 24-L-50, 24-L-60, 24-L-60N, 24-L-75, 24-L-92, and 24-L-98N, all sold under the Genapol® tradename.

The total amount of the detersive nonionic surfactant constituent may be present in amounts of from about 0.01%-10% by weight, more desirably from about 0.01%-5% by weight. based on the total weight of the compositions of which they form a part.

According to certain preferred embodiments the nonionic surfactant constituent comprises at least two individual nonionic surfactants outlined above, as opposed to a single nonionic surfactant.

In accordance with a further preferred embodiment the detersive nonionic surfactant constituent consists essentially of a pair of individual nonionic surfactants which are present in respective weight ratios of 0.5-1:0.5-1, more preferably in a respective weight ratio of 0.75-1:0.75-1. Most desirably the detersive nonionic surfactant constituent consists essentially of a pair of individual nonionic surfactants are present in approximately equal amounts.

In accordance with a still further preferred embodiment of the invention the detersive nonionic surfactant comprises two or more nonionic surfactants which are based on an alkyl alkoxylate wherein the alkyl group present in the molecule of each of the two or more nonionic surfactants is the same, but the two or more nonionic surfactants differ from one another only in the degree of alkoxylation, preferably only in the degree of ethoxylation. Desirably the differences in the degree of alkoxylation is not more than 60%, more preferably is not more than 50% and yet more preferably is not more than 35%, with reference to the nonionic surfactant having the highest degree or amount of alkoxylation. By way of non-limiting example, such would be satisfied by providing two or more detersive nonionic surfactants which are based on the same type of alkyl group, but having different average degrees or amount of alkoxylation, viz., ethoxylation, e.g., a pair of ethoxylated alcohols wherein a first detersive nonionic surfactant would have an average degree of (or alternately an average number of moles) of ethoxylation of 6, and a first detersive nonionic surfactant would have an average degree of (or alternately an average number of moles) of ethoxylation of 8, as the difference in the degree of alkoxylation using the latter compound having a degree of ethoxylation of "8", would be "25%", as former nonionic compound has a degree of ethoxylation of "6".

In certain particularly preferred embodiments, the detersive nonionic surfactant constituent is a pair of alkyl alkoxylates wherein the alkyl group present in the molecule of each of the two or more nonionic surfactants is the same, and is preferably comprises an alkyl group of between about $C_8$-$C_{12}$, but the two or more nonionic surfactants differ from one another only in the degree of alkoxylation wherein the degree of difference is not more than 35%, and more preferably is not more than 25%.

The identity of, and preferred amounts of particularly preferred detersive nonionic surfactants are disclosed with reference to one or more of the following Examples.

The inventive compositions also necessarily comprise an alkylene glycol ether solvent constituent including compounds having the general structure $R_a$—O—$R_b$—OH, wherein $R_a$ is an alkyl of 1 to 20 carbon atoms, or an aryl of at least 6 carbon atoms, and $R_b$ is an alkylene of 1 to 8 carbons or is an ether or polyether containing from 2 to 20 carbon atoms.

Further exemplary glycol ethers include Exemplarly glycol ethers include ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono-, di-, and tri-propylene glycol monoethyl ether, mono-, di- and tri-propylene glycol monopropyl ether, mono-, di-, and tri-propylene glycol monopentyl ether, mono-, di-, and tri-propylene glycol monohexyl ether, mono-, di- and tri-butylene glycol mono methyl ether, mono-, di- and tri-butylene glycol monoethyl ether, mono-, di- and tri-butylene glycol monopropyl ether, mono-, di- and tri-butylene glycol monobutyl ether, mono-, di- and tri-butylene glycol monopentyl ether and mono-, di- and tri-butylene glycol monohexyl ether, as well as ethylene glycol monoacetate and dipropylene glycol propionate and mixtures thereof. Such materials are commercially available from a variety of sources, including in the DOWANOL series of solvents and in the ARCOSOLV series of solvents.

While in certain embodiments of the invention monohydric alcohols, such as $C_1$-$C_8$ monohydric primary, secondary or tertiary alcohols may be included, in certain further preferred embodiments monohydric alcohols are expressly excluded from the inventive compositions.

The alkylene glycol ether solvent constituent is desirably present in the hard surface cleaning compositions of the invention in amounts of from about 0.01%-5% by weight, more desirably from about 0.01%-2% by weight, and most preferably from about 0.01-1.5% wt. based on the total weight of the compositions of which they form a part.

The inventive compositions also necessarily comprise a phenyl containing glycol ether solvent. These solvents may be distinguished from commonly utilized alkylene glycol ether solvents in that they contain a phenyl group in their structure, and may be also termed as alkylene glycol phenyl ethers. Such phenyl containing glycol ether solvents are typically very slow evaporating materials which are also highly hydrophobic and exhibit very poor miscibility in water. Such properties have dissuaded their use in highly aqueous cleaning compositions, such as prior art hard surface cleaning compositions. The present inventors have surprisingly found however that according to the compositions of the present invention, such phenyl containing glycol ether solvents may be readily dispersed and further, that such phenyl containing glycol ether solvents even when dissolved or dispersed in such highly aqueous compositions provide a good cleaning benefit to hard surfaces, particularly to greasy soil laden hard surfaces. An exemplary greasy soil is that described in the following examples. The inventors have also surprisingly found that such compositions are also stable over time under adverse storage conditions, e.g., at reduced temperatures, including below freezing, as well as elevated temperatures. Such are particularly advantageous properties not only from a technical cleaning performance standpoint but from a commercial standpoint as well as such suggests good long term storage an shelf stability without separation of the highly hydrophobic phenyl containing glycol ether solvents from the largely aqueous compositions of which they form a part.

Exemplary useful phenyl containing glycol ether solvents include those which may be represented by the following general structural representation (I):

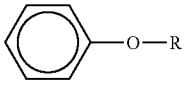

(I)

wherein R is a $C_1$-$C_6$ alkyl group which contains at least one —OH moiety, and preferably R is selected from: $CH_2OH$, $CH_2CH_2OH$, $CH(OH)CH_3$, $CH(OH)CH_2OH$, $CH_2CH_2CH_2OH$, $CH_2CH(OH)CH_3$, $CH(OH)CH_2CH_3$, $CH(OH)CH_2CH_2OH$, $CH(OH)CH(OH)CH_3$, and $CH(OH)CH(OH)CH_2OH$, and the phenyl ring may optionally substituted with one or more further moieties such as $C_1$-$C_3$ alkyl groups but is preferably unsubstituted.

A particularly useful phenyl containing glycol ether solvent is commercially supplied as DOWANOL PPH, described to be a propylene glycol phenyl ether which is described by it supplier as being represented by the following structural representation (II):

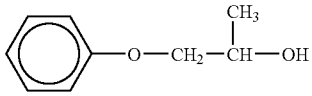

(II)

and further, indicated is that the major isomer is as indicated, which suggests that other alkyl isomers are also present.

The phenyl containing glycol ether solvent constituent may be a single phenyl containing glycol ether solvent, or may be a plurality of phenyl containing glycol ether solvents and is desirably present in the hard surface cleaning compositions of the invention in amounts of from about 0.01%-5% by weight, more desirably from about 0.01%-2% by weight, and most preferably from about 0.01-1% wt. based on the total weight of the compositions of which they form a part.

While in certain embodiments of the invention monohydric alcohols, such as $C_1$-$C_8$ monohydric primary, secondary or tertiary alcohols may be included, in certain further preferred embodiments monohydric alcohols are expressly excluded from the inventive compositions. However, when present one or more monohydric alcohols may be included in amounts of to 5% wt, preferably in amounts of 0.01-5% wt, and most preferably from 0.01-3.5% wt. based on the total weight of the compositions of which they form a part.

The present inventor has surprisingly found that highly effective cleaning of hard surfaces may be achieved at reduced levels of organic solvents wherein the organic solvents present in the inventive compositions are a pair of organic solvents with the first being an the alkylene glycol ether solvent constituent, and the second being the phenyl containing glycol ether solvent constituent and wherein the respective weight ratios of the former to the latter are maintained at 1:0.1-0.75, preferably 1:0.1-0.6, yet more preferably 1:0.15-0.55, and still more preferably at respective weight ratios of the alkylene glycol ether solvent constituent: the phenyl containing glycol ether solvent constituent in the range of 1:0.15-0.5, and especially 1:0.2-0.4. Surprisingly good cleaning efficacy has been observed with reduced levels or organic solvents even in the absence of organic solvents based on monohydric alcohols.

The compositions of the invention also necessarily include an organic acid constituent. Exemplary useful organic acids include any known art organic acid which may be found effective in the inventive compositions. Generally useful organic acids are those which include at least one carbon atom, and include at least one carboxyl group (—COOH) in its structure. Preferred are water soluble organic acids which contain from 1 to about 6 carbon atoms, and at least one carboxyl group as noted and exemplary useful organic acids include: linear aliphatic acids such as formic acid, acetic acid, propionic acid, butyric acid and valeric acid; dicarboxylic acids such as oxalic acid, malonic acid, succinic acid, glutaric acid, adipic acid, pimelic acid, fumaric acid and maleic acid; acidic amino acids such as glutamic acid and aspartic acid; and hydroxy acids such as glycolic acid, lactic acid, hydroxyacrylic acid, alpha-hydroxybutyric acid, glyceric acid, tartronic acid, malic acid, tartaric acid and citric acid, as well as acid salts of these organic acids.

Preferred examples of the organic acid to be used in the present invention include linear aliphatic acids such as formic acid, acetic acid, propionic acid, butyric acid and valeric acid; dicarboxylic acids such as oxalic acid, malonic acid, succinic acid, glutaric acid, adipic acid, pimelic acid, fumaric acid and maleic acid; acidic amino acids such as glutamic acid and aspartic acid; and hydroxy acids such as glycolic acid, lactic acid, hydroxyacrylic acid, alpha-hydroxybutyric acid, glyceric acid, tartronic acid, malic acid, tartaric acid and citric acid, as well as acid salts of these organic acids. Preferred useful organic acids include citric acid, cresylic acid, dodecylbenzene sulfonic acid, phosphoric acid, salicylic acid, sorbic acid, sulfamic acid, acetic acid, benzoic acid, boric acid, capric acid, caproic acid, cyanuric acid, dihydroacetic acid, dimethylsulfamic acid, polyacrylic acid, 2-ethyl-hexanoic acid, fumaric acid, I-glutamic acid, isopropyl sulfamic acid, naphthenic acid, oxalic acid, phosphorous acid, valeric acid, benzene sulfonic acid, xylene sulfonic acid, sulfonic acids, maleic acid, acetic acid, adipic acid, formic acid, lactic acid, butyric acid, gluconic acid, malic acid, tartaric acid, as well as glycolic acid.

These acids can be used singly or as a mixture of two or more individual acids. While they may be present in any effective amount in order to attain a desired acidic pH, advantageously they are present in an amount of from about 0.001-15% wt., more preferably from 0.1-10% wt., yet more preferably from 0.5-5% wt. based on the total weight of the compositions of which they form a part.

In certain preferred embodiments of the invention the sole acids present are one or more of: citric acid, and/or lactic acid to the exclusion of other acids.

In certain especially preferred embodiments of the invention there is only a single acid present, selected from citric acid and lactic acid, only one of which is present to the exclusion of other acids. Most preferably citric acid is the sole acid present.

Water is the primary constituent of the inventive compositions as the compositions are largely aqueous in nature, and comprise at least 75% wt., preferably at least about 80% wt. water, more preferably at least about 85% wt. water, still preferably at least about 88% wt., and in certain preferred embodiments comprise at least about 90% wt. water. The amount of water is added to order to provide to 100% by weight of the compositions of the invention. The water may be tap water, but is preferably distilled water, and is most preferably deionized water or soft water. If the water is tap water, it is preferably substantially free of any undesirable impurities such as organics or inorganics, especially minerals salts which are present in hard water which may thus undesirably interfere with the operation of the constituents present in the aqueous compositions according to the invention.

The compositions are acidic and exhibit a pH of less than 7. Desirably the compositions exhibit a pH in the range of about 1 5, preferably from about 2-4, and most preferably exhibit a pH in the range of from about 2.5-3.5.

The compositions of the present invention can also optionally comprise one or more further constituents which are directed to improving the aesthetic or functional features of the inventive compositions. Such conventional additives known to the art include but not expressly enumerated here may also be included in the compositions according to the invention. By way of non-limiting example without limitation these may include: inorganic acids, chelating agents, coloring agents, light stabilizers, fragrances, thickening agents, abrasives, hydrotropes, pH adjusting agents or pH buffers, film forming constituents, further detersive surfactants as well as other conventional additives known to the relevant art. Many of these materials are known to the art, per se, and are described in *McCutcheon's Detergents and Emulsifiers*, North American Edition, 1998; *Kirk-Othmer, Encyclopedia of Chemical Technology,* 4th Ed., Vol. 23, pp. 478-541 (1997. Such optional, i.e., non-essential constituents should be selected so to have little or no detrimental effect upon the desirable characteristics of the present invention.

The inventive compositions may include one or more constituents useful as pH adjusting agent or pH buffers. The compositions according to the invention optionally but desirably include an amount of a pH adjusting agent or pH buffer composition. Such compositions include many which are known to the art and which are conventionally used. By way of non-limiting example pH adjusting agents include phosphorus containing compounds, monovalent and polyvalent salts such as of silicates, carbonates, and borates, certain acids and bases, tartrates and certain acetates. Further exemplary pH adjusting agents include mineral acids, basic compositions, and organic acids, which are typically required in only minor amounts. By way of further non-limiting example pH buffering compositions include the alkali metal phosphates, polyphosphates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use as buffers such materials as aluminosilicates (zeolites), borates, aluminates and certain organic materials such as gluconates, succinates, maleates, and their alkali metal salts. Desirably the compositions according to the invention include an effective amount of an organic acid and/or an inorganic salt form thereof which may be used to adjust and maintain the pH of the compositions of the invention to the desired pH range. Particularly useful are alkali metal and alkaline hydroxides, especially sodium hydroxide which materials are widely available and which are effective.

The compositions may also include an inorganic acid constituent, including for example: sulfuric acid, phosphoric acid, potassium dihydrogenphosphate, sodium dihydrogenphosphate, sodium sulfite, potassium sulfite, sodium pyrosulfite (sodium metabisulfite), potassium pyrosulfite (potassium metabisulfite), acid sodium hexametaphosphate, acid potassium hexametaphosphate, acid sodium pyrophosphate, acid potassium pyrophosphate, hydrochloric acid, and sulfamic acid. Other water dispersible or water soluble inorganic or mineral acids not specifically eludicated may also be included, however according to certain particularly preferred embodiments are expressly excluded from the compositions of the invention.

In addition to the essential detersive anionic surfactant constituent and the detersive nonionic surfactant constituent the inventive compositions may include one or more further surfactants selected from one or more further anionic, nonionic, cationic, amphoteric or zwitterionic surfactants. Such further surfactants include materials and compounds which are per se, known to the art.

Advantageously included constituents are one or more coloring agents which find use in modifying the appearance of the compositions and enhance their appearance from the perspective of a consumer or other end user. Known coloring agents, such as dyestuffs may be incorporated in the compositions in effective amounts.

The compositions of the invention optionally but in certain cases desirably include a fragrance constituent. Fragrance raw materials may be divided into three main groups: (1) the essential oils and products isolated from these oils; (2) products of animal origin; and (3) synthetic chemicals.

The essential oils consist of complex mixtures of volatile liquid and solid chemicals found in various parts of plants. Mention may be made of oils found in flowers, e.g., jasmine, rose, mimosa, and orange blossom; flowers and leaves, e.g., lavender and rosemary; leaves and stems, e.g., geranium, patchouli, and petitgrain; barks, e.g., cinnamon; woods, e.g., sandalwood and rosewood; roots, e.g., angelica; rhizomes, e.g., ginger; fruits, e.g., orange, lemon, and bergamot; seeds, e.g., aniseed and nutmeg; and resinous exudations, e.g., myrrh. These essential oils consist of a complex mixture of chemicals, the major portion thereof being terpenes, including hydrocarbons of the formula $(C_5H_8)_n$ and their oxygenated derivatives. Hydrocarbons such as these give rise to a large number of oxygenated derivatives, e.g., alcohols and their esters, aldehydes and ketones. Some of the more important of these are geraniol, citronellol and terpineol, citral and citronellal, and camphor. Other constituents include aliphatic aldehydes and also aromatic compounds including phenols such as eugenol. In some instances, specific compounds may be isolated from the essential oils, usually by distillation in a commercially pure state, for example, geraniol and citronellal from citronella oil; citral from lemon-grass oil; eugenol from clove oil; linalool from rosewood oil; and safrole from sassafras oil. The natural isolates may also be chemically modified as in the case of citronellal to hydroxy citronellal, citral to ionone, eugenol to vanillin, linalool to linalyl acetate, and safrol to heliotropin.

Animal products used in perfumes include musk, ambergris, civet and castoreum, and are generally provided as alcoholic tinctures.

The synthetic chemicals include not only the synthetically made, also naturally occurring isolates mentioned above, but also include their derivatives and compounds unknown in nature, e.g., isoamylsalicylate, amylcinnamic aldehyde, cyclamen aldehyde, heliotropin, ionone, phenylethyl alcohol, terpineol, undecalactone, and gamma nonyl lactone.

Fragrance compositions as received from a supplier may be provided as an aqueous or organically solvated composition, and may include as a hydrotrope or emulsifier a surface-active agent, typically a surfactant, in minor amount. Such fragrance compositions are quite usually proprietary blends of many different specific fragrance compounds. However, one of ordinary skill in the art, by routine experimentation, may easily determine whether such a proprietary fragrance composition is compatible in the compositions of the present invention.

The compositions of the invention may include one or more constituents which provide a thickening benefit to the compositions. The selection of such thickener constituent must of course take into consideration the highly alkaline nature of the compositions.

An exemplary class of useful thickeners include organic polymeric thickeners include polycarboxylate polymers having a molecular weight from about 500,000 to about 4,000,000, preferably from about 1,000,000 to about 4,000,000, with, preferably, from about 0.5% to about 4% crosslinking. Preferred polycarboxylate polymers include polyacrylate polymers including those sold under trade names Carbopol®, Acrysol® ICS-1 and Sokalan®. The preferred polymers are polyacrylates. Other monomers besides acrylic acid can be used to form these polymers including such monomers as ethylene and propylene which act as diluents, and maleic anhydride which acts as a source of additional carboxylic groups. Another example of polymeric based thickeners are those based on polyacrylamides. One example is Solagum from Seppic.

Another class of thickeners include colloid-forming clays, for example, such as smectite and/or attapulgite types. Inorganic colloid forming clays tend to provide higher stability in the presence of chlorine and do not thin when subjected to shear.

The clay materials can be described as expandable layered clays, i.e., aluminosilicates and magnesium silicates. The term "expandable" as used to describe the instant clays relates to the ability of the layered clay structure to be swollen, or expanded, on contact with water. The expandable clays used herein are those materials classified geologically as smectites (or montmorillonite) and attapulgites (or polygorskites). Smectites are three-layered clays. There are two distinct classes of smectite-type clays. In the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O_5)(OH)_2$, for the aluminum magnesium oxide type clays, respectively. It is to be recognized that the range of the water of hydration in the above formulas may vary with the processing to which the clay has been subjected.

Commercially available clays include, for example, montmorillonite (bentonite), volchonskoite, nontronite, beidellite, hectorite, saponite, sauconite and vermiculite. The clays herein are available under various trade names such as Gelwhite H NF and Gelwhite GP from Southern Clay Products. (both montmorillonites); Van Gel O from R. T. Vanderbilt, smectites, laponites and layered silicates from Southern Clay Products. A second type of expandable clay material useful in the instant invention is classified geologically as attapulgite (polygorskite). Attapulgites are magnesium-rich clays having principles of superposition of tetrahedral and octahedral unit cell elements different from the smectites. Like the smectites, attapulgite clays are commercially available. For example, such clays are marketed under the tradename Attagel, i.e. Attagel 40, Attagel 50 and Attagel 150 from BASF AG.

Another optional constituent of the present invention is at least one abrasive. Examples of abrasive materials include oxides, carbonates, quartzes, siliceous chalk, diatomaceous earth, colloidal silicon dioxide, alkali metasilicates, organic abrasive materials selected from polyolefins, polyethylenes, polypropylenes, polyesters, polystyrenes, acetonitrile-butadiene-styrene resins, melamines, polycarbonates, phenolic resins, epoxies and polyurethanes, natural materials selected from rice hulls, corn cobs, and the like, nepheline syenite, or talc and mixtures thereof. The particle size of the abrasive agent can range from about 1 μm to about 1000 μm, preferably between about 10 μm to about 200 μm, and more preferably between about 10 μm and about 100 μm. It is preferred to us those abrasive agents that will not scratch glass or ceramic surfaces. Such abrasive agents include calcium carbonate, siliceous chalk, diatomaceous earth, colloidal silicon dioxide, sodium metasilicate, talc, and organic abrasive materials. Calcium carbonate is preferred.

One particularly preferred optional constituent is a film forming polymer based on quaternized copolymers of vinylpyrrolidone and dimethylaminoethyl methacrylate, of which such preferred polymers include those described in U.S. Pat. No. 4,080,310, to Ng, the contents of which are herein incorporated by reference. Such quaternized copolymers include those according to the general formula:

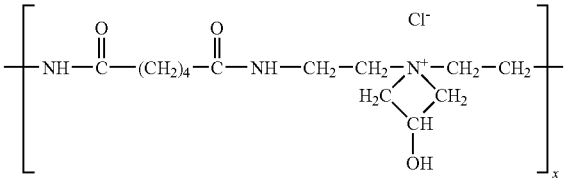

wherein "x" is about 40 to 60. Further exemplary useful copolymers include copolymers of vinylpyrrolidone and dimethylaminoethylmethacrylate quaternized with diethyl sulphate (available as Gafquat® 755 ex., ISP Corp., Wayne, N.J.).

In certain particularly embodiments such film forming polymers based on quaternized copolymers of vinylpyrrolidone and dimethylaminoethyl methacrylate form an essential constituent of the invention. When present, they may be included in any effective amount, but advantageously are present in amounts of from 0.001-0.5% wt, more preferably in amounts of from 0.001-0.2% wt, and most preferably, when present, are present in amounts of from 0.01-0.12% wt. based on the total weight of the compositions of which they form a part.

Ideally the inclusion of any further constituents which are directed to improving the aesthetic or functional features of the inventive compositions but should be minimized in order to minimize the likelihood of deleterious effects such as reduced cleaning benefit, or reduction in the stability of the compositions according to the invention. When one or more such optional constituents are present, preferably, in total they comprise not more than 10% wt., more preferably not more than 7.5% wt, still more preferably not more than 5% wt., and most preferably not more than about 2.5% wt of an inventive composition of which they form a part.

The compositions of the inventions may be produced by simple mixing of the constituents in water, preferably at least a major proportion of the deionized water is provided at room temperature to which is added under constant stirring the surfactant constituent, followed by the organic solvent constituent, and finally any optional constituent which may be included. Mixing continues until a homogenous mixture of the constituents is formed, after which mixing may be stopped and the compositions are ready for use. These as mixed compositions are preferably used without further dilution prior to their use in the treatment of hard surfaces.

Hard surface cleaning composition according to the invention is desirably provided as a ready to use product which may be directly applied to a hard surface. By way of example, hard surfaces include surfaces composed of refractory materials such as: glazed and unglazed tile, brick, porcelain, ceramics as well as stone including marble, granite, and other stones surfaces; glass; metals; plastics e.g. polyester, vinyl; fiberglass, Formica®, Corian® and other hard surfaces known to the industry. Hard surfaces which are to be particularly denoted are lavatory fixtures such as shower stalls, bathtubs and bathing appliances (racks, curtains, shower doors, shower bars) toilets, bidets, wall and flooring surfaces especially those which include refractory materials and the like. Further hard surfaces which are to be denoted are those associated with kitchen environments and other environments associated with food preparation, including cabinets and countertop surfaces as well as walls and floor surfaces especially those which include refractory materials, plastics, Formica®, Corian® and stone. Such hard surfaces described above are to be understood as being recited by way of illustration and not be way of limitation.

The compositions of the invention may be formulated so to be supplied in as non-pressurized containers such as rigid containers or flasks, as well as in deformable containers or flask from which the inventive compositions may be dispensed. The non-pressurized containers may be provided with a conventional trigger-pump spray apparatus which when actuated by a user, is used to withdraw a quantity of the composition from the container and expel it from the trigger-pump spray apparatus as a spray or stream which may be directed to a hard surface in need of treatment.

The compositions of the invention may be formulated with conventional propellants for dispensing as aerosols from conventional pressurized containers. Propellants which may be used are well known and conventional in the art and include, for example, a hydrocarbon, of from 1 to 10 carbon atoms, such as n-propane, n-butane, isobutane, n-pentane, isopentane, and mixtures thereof; dimethyl ether and blends thereof as well as individual or mixtures of chlorofluoro- and/or fluorohydrocarbons- and/or hydrochlorofluorocarbons (HCFCs). Useful commercially available hydrocarbon based propellant compositions include A-70 (Aerosol compositions with a vapor pressure of 70 psig available from companies such as Diversified and Aeropress.), as well as fluorocarbon based propellant compositions such as DYMEL 152A (commercially available from DuPont.) Compressed gases such as carbon dioxide, compressed air, nitrogen, and possibly dense or supercritical fluids may also be used.

The amount of propellant employed should provide a suitable spray pattern and for essentially complete expulsion of the composition from the aerosol container. The appropriate amount to be used for any particular aerosol propellant system can readily be determined by one skilled in the art. Preferably, the propellants comprise about 1% to about 50% of the aerosol formulation with preferred amounts being from about 2% to about 25%, more preferably from about 5% to about 15%. Generally speaking, the amount of a particular propellant employed should provide an internal pressure of from about 20 to about 150 psig at 70° F.

The composition of the present invention, can also be applied to a hard surface by using a wet wipe preimpreganted with a quantity of the inventive composition. The wipe can be of a woven or non-woven nature. Fabric substrates can include nonwoven or woven pouches, sponges, in the form of abrasive or non-abrasive cleaning pads. Such fabrics are known commercially in this field and are often referred to as wipes. Such substrates can be resin bonded, hydroentangled, thermally bonded, meltblown, needlepunched, or any combination of the former.

Such nonwoven fabrics may be a combination of wood pulp fibers and textile length synthetic fibers formed by well known dry-form or wet-lay processes. Synthetic fibers such as rayon, nylon, orlon and polyester as well as blends thereof can be employed. The wood pulp fibers should comprise about 30 to about 60 percent by weight of the nonwoven fabric, preferably about 55 to about 60 percent by weight, the remainder being synthetic fibers. The wood pulp fibers provide for absorbency, abrasion and soil retention whereas the synthetic fibers provide for substrate strength and resiliency. The substrate of the wipe may also be a film forming material such as a water soluble polymer. Such self-supporting film substrates may be sandwiched between layers of fabric substrates and heat sealed to form a useful substrate. The free standing films can be extruded utilizing standard equipment to devolatilize the blend. Casting technology can be used to form and dry films or a liquid blend can be saturated into a carrier and then dried in a variety of known methods.

The compositions of the present invention are absorbed onto the wipe to form a saturated wipe. The wipe can then be sealed individually in a pouch which can then be opened when needed or a multitude of wipes can be placed in a container for use on an as needed basis. The container, when closed, sufficiently sealed to prevent evaporation of any components from the compositions.

The compositions are readily used in the cleaning of hard surfaces by application a cleaning effective amount of a hard surface cleaning composition according to any of the prior recited inventive aspects to a hard surface in need of such treatment, and concurrently or subsequently, wiping the surface with a cloth, wipe or wiping article.

The following examples exhibit exemplary and preferred formulations of the invention. It is to be understood that these examples are provided by way of illustration only and that further useful formulations falling within the scope of the present invention and the claims may be readily produced by one skilled in the art without deviating from the scope and spirit of the invention.

EXAMPLES

Formulations according to the invention were produced by mixing the constituents outlined in Table 1 by adding the individual constituents into a beaker of deionized water at room temperature which was stirred with a conventional magnetic stirring rod. Stirring continued until each of the formulations were homogenous in appearance. It is to be noted that the constituents might be added in any order, but it is preferred that a major proportion of water be the initial constituent provided to a mixing vessel or apparatus as it is the major constituent and addition of the further constituents thereto is convenient. Still more preferably to a major part of the water which is maintained under constant stirring are added the constituents in the following sequence: organic solvent(s), nonionic surfactant(s), anionic surfactant(s), acid(s), pH adjusting agent(s)/pH buffer(s), fragrance(s)/colorant(s), and polymer, with a sufficient time lapse between the addition of each constituent in order to ensure that the immediately prior added constituent has been homogenously blended. After the addition of the final constituent, mixing continued for 5-60 minutes to ensure homogenous blending and that a clear solution was obtained. These compositions according to the examples are indicated by the letter "E" followed by a digit.

Certain compositions which are considered to be "comparative examples" were also produced in the manner described above and using the same constituents, and these comparative examples are indicated on Table 2, following. These compositions according to the comparative examples are indicated by the letter "C" followed by a digit.

TABLE 1

| | E1 | E2 | E3 | E4 | E5 | E6 | E7 | E8 |
|---|---|---|---|---|---|---|---|---|
| sodium dodecylbenzene sulfonate (40%) | 2 | 2.5 | 1.5 | 2.5 | 2.5 | 1.5 | 1.5 | 2.5 |
| $C_9$-$C_{11}$ alcohol ethoxylate, avg. 6 mols ethoxylation | 0.75 | 1 | 1 | 1 | 0.5 | 0.5 | 0.5 | 0.5 |
| $C_9$-$C_{11}$ alcohol ethoxylate, avg. 8 mols ethoxylation | 0.35 | — | — | 0.7 | 0.7 | 0.7 | — | — |
| dipropylene glycol n-butyl ether | 2 | 1 | 3 | 3 | 1 | 3 | 1 | 3 |
| propylene glycol phenyl ether | 0.5 | 1 | 1 | 1 | 1 | 1 | 1 | 1 |
| anhydrous citric acid | 3.5 | 3.5 | 3.5 | 3.5 | 3.5 | 3.5 | 3.5 | 3.5 |
| lactic acid | — | — | — | — | — | — | — | — |
| sodium hydroxide (50%) | 1 | 1 | 1 | 1 | 1 | 1 | — | 1 |
| fragrance | 0.25 | 0.25 | 0.25 | 0.25 | 0.25 | 0.25 | 0.25 | 0.25 |
| colorant | — | — | — | — | — | — | — | — |
| polymer | 0.08 | 0.08 | 0.08 | 0.08 | 0.08 | 0.08 | 0.08 | 0.08 |
| d.i. water | q.s. | q.s | q.s. | q.s. | q.s. | q.s. | q.s. | q.s. |

| | E9 | E10 | E11 | E12 | E13 |
|---|---|---|---|---|---|
| sodium dodecylbenzene sulfonate (40%) | 1.5 | 2 | 3 | 4 | 4 |
| $C_9$-$C_{11}$ alcohol ethoxylate, avg. 6 mols ethoxylation | 1 | 0.75 | 0.4 | 0.4 | 0.4 |
| $C_9$-$C_{11}$ alcohol ethoxylate, avg. 8 mols ethoxylation | 0.7 | 0.35 | 0.4 | 0.4 | 0.4 |
| dipropylene glycol n-butyl ether | 1 | 2 | 1 | 1 | 1 |
| propylene glycol phenyl ether | 1 | 0.5 | 0.2 | 0.4 | 0.4 |
| anhydrous citric acid | 3.5 | 3.5 | 3.5 | — | — |
| lactic acid | — | — | — | 4 | 4 |
| sodium hydroxide (50%) | 1 | 1 | 1 | 0.54 | 0.54 |
| fragrance | 0.25 | 0.25 | 0.25 | 0.25 | 0.25 |
| colorant | — | — | — | 0.005 | — |
| polymer | 0.08 | 0.08 | 0.08 | 0.1 | 0.1 |
| d.i. water | q.s. | q.s. | q.s. | q.s. | q.s. |

TABLE 2

(Comparative Examples)

| | C1 | C2 | C3 | C4 | C5 | C6 | C7 | C8 |
|---|---|---|---|---|---|---|---|---|
| sodium dodecylbenzene sulfonate (40%) | 1.5 | 1.5 | 2.5 | 2.5 | 1.5 | 2.5 | 1.5 | 2.5 |
| $C_9$-$C_{11}$ alcohol ethoxylate, avg. 6 mols ethoxylation | 1 | 1.5 | 1 | 1 | 1 | 0.5 | 0.5 | 0.5 |
| $C_9$-$C_{11}$ alcohol ethoxylate, avg. 8 mols ethoxylation | 0.7 | — | — | 0.7 | — | 0.7 | 0.7 | — |
| dipropylene glycol n-butyl ether | 3 | 3 | 3 | 2 | 1 | 3 | 1 | 1 |
| propylene glycol phenyl ether | — | — | — | — | — | — | — | — |
| anhydrous citric acid | 3.5 | 3.5 | 3.5 | 3.5 | 3.5 | 3.5 | 3.5 | 3.5 |
| lactic acid | — | — | — | — | — | — | — | — |
| sodium hydroxide (50%) | 1 | 1 | 1 | 1 | 1 | 1 | 1 | 1 |
| fragrance | 0.25 | 0.25 | 0.25 | 0.25 | 0.25 | 0.25 | 0.25 | 0.25 |
| colorant | — | — | — | — | — | — | — | — |
| polymer | 0.08 | 0.08 | 0.08 | 0.08 | 0.08 | 0.08 | 0.08 | 0.08 |
| d.i. water | q.s. | q.s. | q.s. | q.s. | q.s. | q.s. | q.s. | q.s. |

The quantity of each identified constituents used to produce the formulations of Tables 1 and 2 is indicated in weight percent, and the indicated amounts are based on the "as supplied" constituents, which may have been less than 100% wt. "actives". In such instances the named constituent is followed by the percentage of % wt. actives, in parenthesis, provided in the "as supplied" constituent. Constituents which are not indicated with a corresponding percentage of % wt. actives, in parenthesis, are to be considered as 99%-100% wt. "active". Also, as indicated deionized water was added to each formulation in quantum sufficient, "q.s." to provide the balance to 100% wt. of each of the example compositions.

The constituents used to form the examples as well as the comparative examples are identified more fully on the following Table 3.

TABLE 3

| | |
|---|---|
| sodium dodecylbenzene sulfonate (40%) | detersive anionic surfactant; BIOSOFT D-40 (40% wt. actives) |
| $C_9$-$C_{11}$ alcohol ethoxylate, avg. 6 mols ethoxylation | detersive nonionic surfactant; TOMADOL 91-6 (98-100% wt. actives) ex. Tomah |
| $C_9$-$C_{11}$ alcohol ethoxylate, avg. 8 mols ethoxylation | detersive nonionic surfactant; TOMADOL 91-8 (98-100% wt. actives) ex. Tomah |
| dipropylene glycol n-butyl ether | organic solvent; supplied as DOWANOL DPnB (99-100% actives) |
| propylene glycol phenyl ether | organic solvent; supplied as DOWANOL PPh (99-100% actives) |
| anhydrous citric acid | anhydrous citric acid, laboratory grade |
| lactic acid | lactic acid, laboratory grade |
| sodium hydroxide (50%) | aqueous sodium hydroxide, 50% wt. actives |
| fragrance | proprietary composition of its supplier |
| colorant | aqueous dispersion of an acid dye |
| polymer | polymer; supplied as GAFQUAT 755, ex. ISP Inc. |
| d.i. water | deionized water or soft water |

Cleaning Evaluation

Cleaning evaluations for greasy soils were performed in accordance with the testing protocol outlined according to ASTM D4488 A2 Test Method, which evaluated the efficacy of the cleaning compositions on masonite wallboard samples painted with wall paint. The soil applied was a greasy soil sample containing vegetable oil, food shortening and animal fat. The sponge (water dampened) of a Gardner Abrasion Tester apparatus was squirted with a 15 gram sample of a tested cleaning composition, and the apparatus was cycled 10 times. The evaluation of cleaning compositions was "paired" with one side of each of the test samples treated with a composition according to the invention, and the other side of the same sample treated with a comparative example's composition, thus allowing a "side-by-side" comparison to be made. Each of these tests were duplicated on at least 4 wallboard tiles and the results statistically analyzed and the averaged results reported on Table 4, below. The cleaning efficacy of the tested compositions were evaluated The cleaning efficacy of the tested compositions were evaluated the cleaning efficacy of the tested compositions was evaluated utilizing a high resolution digital imaging system which evaluated the light reflectance characteristics of the each tested sample wallboard sample. This system utilized a photographic copy stand mounted within a light box housing which provided diffuse, reflected light supplied by two 15 watt, 18 inch type T8 fluorescent bulbs rated to have a color output of 4100K which approximated "natural sunlight" as noted by the manufacturer. The two fluorescent bulbs were positioned parallel to one another and placed parallel and beyond two opposite sides of the test substrate (test tile) and in a common horizontal plane parallel to the upper surface of the test substrate being evaluated, and between the upper surface of the tile and the front element of the lens of a CCD camera. The CCD camera was a "QImaging Retiga series" CCD camera, with a Schneider-Kreuznach Cinegon Compact Series lens, f1.9/10 mm, 1 inch format (Schneider-Kreuznach model #21-1001978) which CCD camera was mounted on the copy stand with the lens directed downwardly towards the board of the copy stand on which a test substrate was placed directly beneath the lens. The light box housing enclosed the photographic copy stand, the two 18 inch fluorescent bulbs and a closeable door permitted for the insertion, placement and withdrawal of a test tile which door was closed during exposure of the CCD camera to a test tile. In such a manner, extraneous light and variability of the light source during the evaluation of a series of tested substrates was minimized, also minimizing exposure and reading errors by the CCD camera.

The CCD camera was attached to a desktop computer via a Firewire IEEE 1394 interface and exposure data from the CCD camera was read by a computer program, "Media Cybernetics Image Pro Plus v. 6.0", which was used to evaluate the exposures obtained by the CCD camera, which were subsequently analyzed in accordance with the following. The percentage of the test soil removal from each test substrate (tile) was determined utilizing the following equation:

$$\%\ \text{Removal} = \frac{RC - RS}{RO - RS} \times 100$$

where

RC=Reflectance of tile after cleaning with test product

RO=Reflectance of original soiled tile

RS=Reflectance of soiled tile the results being reported as "% soil removal."

Additionally the cleaning performance of the tested compositions were evaluated in the same manner against several comparative example formulations which were produced and which are described on prior Table 2.

TABLE 4

| | % average soil removal |
|---|---|
| E1 | 79.77 |
| E2 | 82.15 |
| E3 | 88.86 |
| E4 | 85.86 |
| E5 | 83.06 |
| E6 | 87.82 |
| E7 | 84.65 |
| E8 | 89.19 |
| E9 | 79.36 |
| E10 | 80.51 |
| C1 | 71.58 |
| C2 | 75.79 |
| C3 | 76.31 |
| C4 | 65.60 |
| C5 | 69.33 |
| C6 | 74.17 |
| C7 | 66.73 |
| C8 | 77.45 |

The results of the cleaning test reported on Table 4 are also illustrated on FIG. 1. As a review of these test results illustrate, compositions which included both an alkylene glycol ether solvent with a phenyl containing glycol ether solvent provided highly effective cleaning while concurrent requiring a reduced total amount of the glycol ether surfactant constituent as compared to similar formulations which omitted the phenyl containing glycol ether solvent.

The invention claimed is:

1. An improved hard surface treatment compositions which comprises the following constituents:
- a detersive anionic surfactant;
- a detersive nonionic surfactant;
- an alkylene glycol ether solvent;
- a phenyl containing glycol ether solvent;
- an organic acid, and,
- water; a film forming polymer based on a quaternized copolymer of vinylpyrrolidone and dimethylaminoethyl methacrylate;
- and optionally one or more further constituents which may improve aesthetic or functional features of the compositions.

2. An improved hard surface treatment composition according to claim 1, wherein the detersive nonionic surfactant constituent consists essentially of a pair of individual nonionic surfactants which are present in respective weight ratios of 0.5-1:0.5-1.

3. An improved hard surface treatment composition according to claim 1, wherein the detersive nonionic surfactant constituent comprises two or more nonionic surfactants which are based on an alkyl alkoxylate wherein the alkyl group present in the molecule of each of the two or more nonionic surfactants is the same, but the two or more nonionic surfactants differ from one another only in the degree of alkoxylation, wherein the differences in the degree of alkoxylation is not more than 60%, with reference to the nonionic surfactant having the highest degree or amount of alkoxylation.

4. An improved hard surface treatment composition according to claim 1, wherein the organic solvents present in the inventive compositions are a pair of organic solvents with the first being the alkylene glycol ether solvent constituent, and the second being the phenyl containing glycol ether solvent constituent and wherein the respective weight ratios of the former to the latter are maintained at 1:1 or less.

5. An improved hard surface treatment composition according to claim 1, wherein monohydric alcohols are excluded from the composition.

6. A method for the cleaning of a hard surface, which method comprises the step of applying a cleaning effective amount of the composition of the invention according to claim 1 to a hard surface in need of a cleaning treatment, particularly a hard surface in need of cleaning greasy soils from a hard surface.

7. An improved hard surface treatment composition according to claim 2 wherein the pair of individual nonionic surfactants which are present in respective weight ratios of 0.75-1:0.75-1.

8. An improved hard surface treatment composition according to claim 3 wherein the detersive nonionic surfactant constituent comprises two or more nonionic surfactants which are based on an alkyl alkoxylate wherein the alkyl group present in the molecule of each of the two or more nonionic surfactants is the same, but the two or more nonionic surfactants differ from one another only in the degree of alkoxylation, wherein the differences in the degree of alkoxylation is not more than 50%, with reference to the nonionic surfactant having the highest degree or amount of alkoxylation.

9. An improved hard surface treatment composition according to claim 8 wherein the detersive nonionic surfactant constituent comprises two or more nonionic surfactants which are based on an alkyl alkoxylate wherein the alkyl group present in the molecule of each of the two or more nonionic surfactants is the same, but the two or more nonionic surfactants differ from one another only in the degree of alkoxylation, wherein the differences in the degree of alkoxylation is not more than 35%, with reference to the nonionic surfactant having the highest degree or amount of alkoxylation.

10. An improved hard surface treatment composition according to claim 4, wherein the organic solvents present in the inventive compositions are a pair of organic solvents with the first being the alkylene glycol ether solvent constituent, and the second being the phenyl containing glycol ether solvent constituent and wherein the respective weight ratios of the former to the latter are maintained at 1:0.1-0.75.

11. An improved hard surface treatment composition according to claim 10, wherein the organic solvents present in the inventive compositions are a pair of organic solvents with the first being the alkylene glycol ether solvent constituent, and the second being the phenyl containing glycol ether solvent constituent and wherein the respective weight ratios of the former to the latter are maintained at 1:0.1-0.6.

12. An improved hard surface treatment composition according to claim 11, wherein the organic solvents present in the inventive compositions are a pair of organic solvents with the first being the alkylene glycol ether solvent constituent, and the second being the phenyl containing glycol ether solvent constituent and wherein the respective weight ratios of the former to the latter are maintained at 1:0.15-0.55.

13. An improved hard surface treatment composition according to claim 1 which consists essentially of the following constituents:
- a detersive anionic surfactant;
- a detersive nonionic surfactant;
- an alkylene glycol ether solvent;
- a phenyl containing glycol ether solvent;
- an organic acid, and,
- a film forming polymer based on a quaternized copolymer of vinylpyrrolidone and dimethylaminoethyl methacrylate;
- water;
- and which optionally one or more further constituents which may improve aesthetic or functional features of the compositions.

14. An improved hard surface treatment composition according to claim 13, wherein the detersive nonionic surfactant detersive nonionic surfactant constituent consists essentially of a pair of individual nonionic surfactants which are present in respective weight ratios of 0.5-1:0.5-1, and wherein the detersive nonionic surfactant constituent comprises two or more nonionic surfactants which are based on an alkyl alkoxylate wherein the alkyl group present in the molecule of each of the two or more nonionic surfactants is the same, but the two or more nonionic surfactants differ from one another only in the degree of alkoxylation, wherein the differences in the degree of alkoxylation is not more than 60%, with reference to the nonionic surfactant having the highest degree or amount of alkoxylation.

15. An improved hard surface treatment composition according to claim 14, wherein the organic solvents present in the inventive compositions are a pair of organic solvents with the first being the alkylene glycol ether solvent constituent, and the second being the phenyl containing glycol ether solvent constituent and wherein the respective weight ratios of the former to the latter are maintained at 1:1 or less, and wherein the respective weight ratios of the former to the latter are maintained at 1:0.1-0.75.

16. An improved hard surface treatment composition according to claim 14, wherein monohydric alcohols are excluded from the composition.

* * * * *